US009162512B2

(12) United States Patent
Alsolami

(10) Patent No.: US 9,162,512 B2
(45) Date of Patent: Oct. 20, 2015

(54) CONVERTIBLE BOOKSTAND COVER

(71) Applicant: UMM AL-QURA UNIVERSITY, Makkah (SA)

(72) Inventor: Badr Alsolami, Makkah (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 105 days.

(21) Appl. No.: 14/171,545

(22) Filed: Feb. 3, 2014

(65) Prior Publication Data

US 2015/0217590 A1 Aug. 6, 2015

(51) Int. Cl.

| | |
|---|---|
| ***B42F 13/00*** | (2006.01) |
| ***B42D 3/06*** | (2006.01) |
| ***A47B 23/04*** | (2006.01) |
| ***A47B 23/06*** | (2006.01) |
| ***B42D 3/02*** | (2006.01) |
| ***B42D 3/12*** | (2006.01) |

(52) U.S. Cl.

CPC ..... *B42D 3/06* (2013.01); *A47B 23/044* (2013.01); *A47B 23/06* (2013.01); *B42D 3/02* (2013.01); *B42D 3/126* (2013.01); *B42F 13/00* (2013.01)

(58) Field of Classification Search

CPC ..... B42F 13/402; B42F 3/126; B42D 1/007; B42D 3/02; B42D 3/06

USPC ..... 281/16, 19.1, 21.1, 29, 33; D19/26; 248/446, 460; 402/73–77

See application file for complete search history.

(56) References Cited

U.S. PATENT DOCUMENTS

| | | | | |
|---|---|---|---|---|
| 323,729 | A * | 8/1885 | Pershing | 281/16 |
| 959,284 | A * | 5/1910 | Turner | 281/29 |
| 1,776,713 | A * | 9/1930 | Whitlock | 281/15.1 |
| 2,056,338 | A * | 10/1936 | Bachrach | 281/29 |
| 2,159,612 | A * | 5/1939 | Barrett | 281/33 |
| 2,375,190 | A | 5/1945 | Botts | |
| 4,377,271 | A | 3/1983 | Smith | |
| 5,485,980 | A | 1/1996 | Luccia | |
| 5,709,409 | A | 1/1998 | Engel | |
| 7,744,128 | B2 | 6/2010 | El-Sorrogy | |
| 2005/0012016 | A1 | 1/2005 | Teuscher | |
| 2005/0269814 | A1 * | 12/2005 | Dillavou et al. | 281/20 |
| 2007/0295677 | A1 | 12/2007 | Kowatari | |
| 2008/0048088 | A1 | 2/2008 | Rucinski et al. | |
| 2009/0315313 | A1 | 12/2009 | Kalman | |
| 2011/0049860 | A1 | 3/2011 | Suh | |
| 2012/0274058 | A1 | 11/2012 | Yair | |

FOREIGN PATENT DOCUMENTS

| | | | |
|---|---|---|---|
| CN | 201849060 U | | 6/2011 |
| DE | 202012009642 | * | 11/2012 |
| FR | 2 827 808 | | 1/2003 |
| KR | 10-2008-0051718 | | 6/2008 |
| WO | WO2007069842 | * | 6/2007 |
| WO | WO2009008684 | * | 1/2009 |

* cited by examiner

*Primary Examiner* — Kyle Grabowski
(74) *Attorney, Agent, or Firm* — Richard C. Litman

(57) ABSTRACT

The convertible bookstand cover a pair of inner covers and a pair of outer covers pivotable with respect to the inner covers. A pair of first and second hinges couples each outer cover to the respective inner cover to facilitate pivotable, unfolding movement of the outer covers. Each outer cover desirably unfolds to about 90 degrees from the folded position to form a vertical bookstand support. A pair of third hinges permits the inner covers to pivot between a closed and unfolded position. When unfolded, the inner covers also form a bookstand support in concert with the outer covers. Each inner and outer cover can be provided with magnets to securely latch an outer cover to the respective inner cover and prevent inadvertent unfolding thereof.

20 Claims, 4 Drawing Sheets

CONVERTIBLE BOOKSTAND COVER

BACKGROUND OF THE INVENTION

1. Field of the Invention

The invention relates to a book support, and particularly to a convertible bookstand cover that provides a book with an integral, auxiliary outer cover that can transform into a support stand for the book.

2. Description of the Related Art

Books are used both as educational tools, as well as for entertainment purposes. The information and/or stories contained in a book can introduce a reader to subject matter that can expand the reader's knowledge or imagination.

The act of reading generally requires a certain amount of time investment, as well as comprehension of the material being read. Manually supporting a book for an extended period of time can be fatiguing to the reader, especially when the book is heavy and/or large. Typically, reader fatigue can be alleviated by resting the book on a surface. However, in this position, the reader is required to constantly peer down towards that surface for an extended period of time. This type of body positioning can be uncomfortable to the reader, lead to neck cramps and/or other forms of physical discomfort. It is generally unnatural for the human body to remain stationary, in one position, for extended periods. Accordingly, studies have suggested that the reader take periodic breaks, and perform some form of minor physical activity, such as stretching or short walks, to minimizing physical discomfort.

Another solution to prevent reader discomfort, is for the reader to use a discrete bookstand to support the book. Bookstands are provided in various forms. A typical bookstand includes a base and a slanted surface, providing a mount to place the book. This type of bookstand is usually portable and configured to rest on top of a desk. However, the convenience of this type of bookstand is generally limited, mainly due to the bulky size and weight, which deters a user from moving the bookstand.

Lightweight bookstands also exist, and can be portable. However, these types of bookstands are generally constructed of inexpensive materials and are rather unstable when it comes to supporting a book, especially if the book is large or heavy. Furthermore, if used frequently, the bookstand generally becomes an additional article for the user to carry around.

Accordingly, a convertible bookstand cover solving the aforementioned problems is desired.

SUMMARY OF THE INVENTION

The convertible bookstand cover a pair of inner covers and a pair of outer covers pivotable with respect to the inner covers. A pair of first and second hinges couples each outer cover to the respective inner cover to facilitate pivotable, unfolding movement of the outer covers. Each outer cover desirably unfolds to about 90 degrees from the folded position to form a vertical bookstand support. A pair of third hinges permits the inner covers to pivot between a closed and unfolded position. When unfolded, the inner covers also form a bookstand support in concert with the outer covers. Each inner and outer cover can be provided with magnets to securely latch an outer cover to the respective inner cover and prevent inadvertent unfolding thereof.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
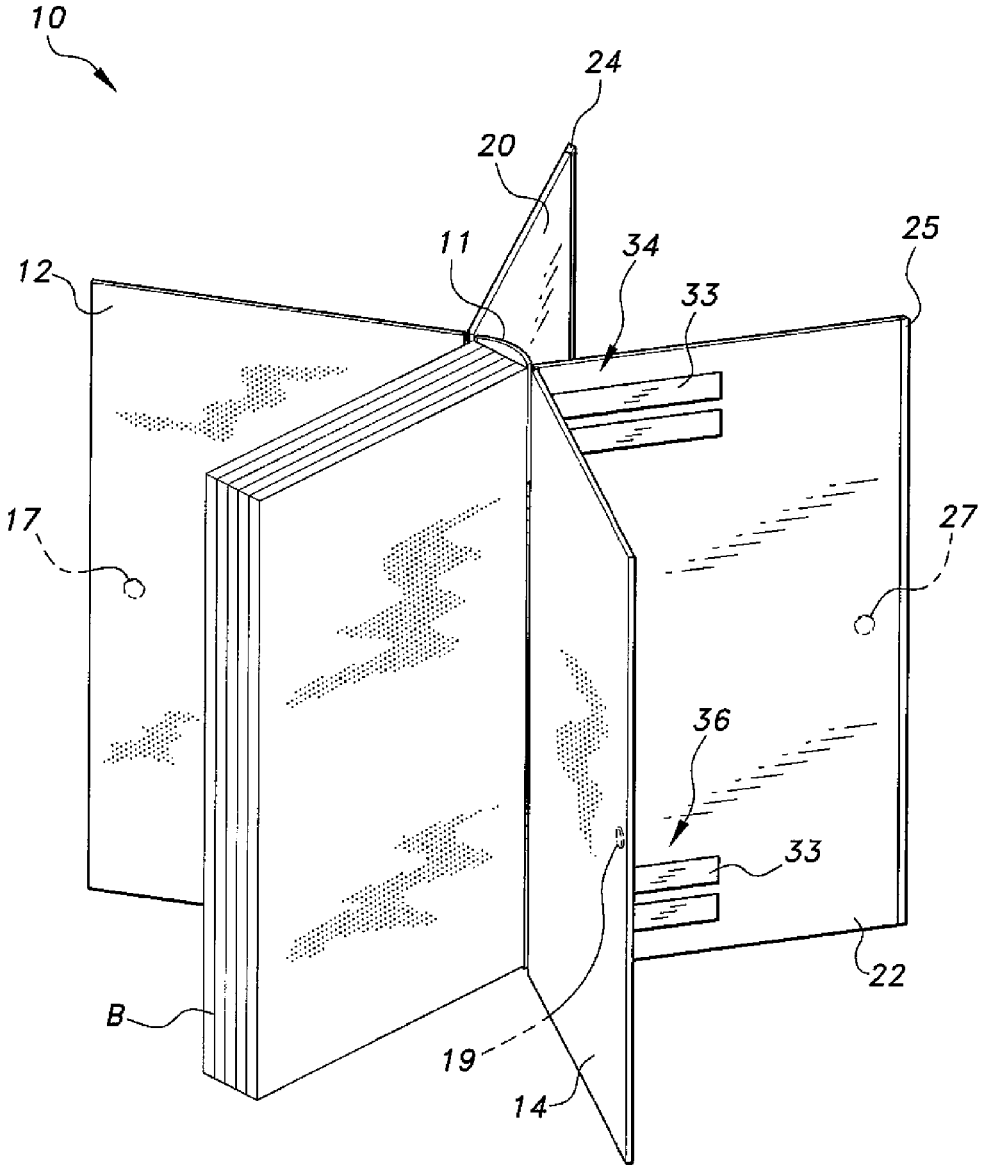
FIG. 1 is an environmental perspective view of a convertible bookstand cover according to the present invention.
Figure 2:
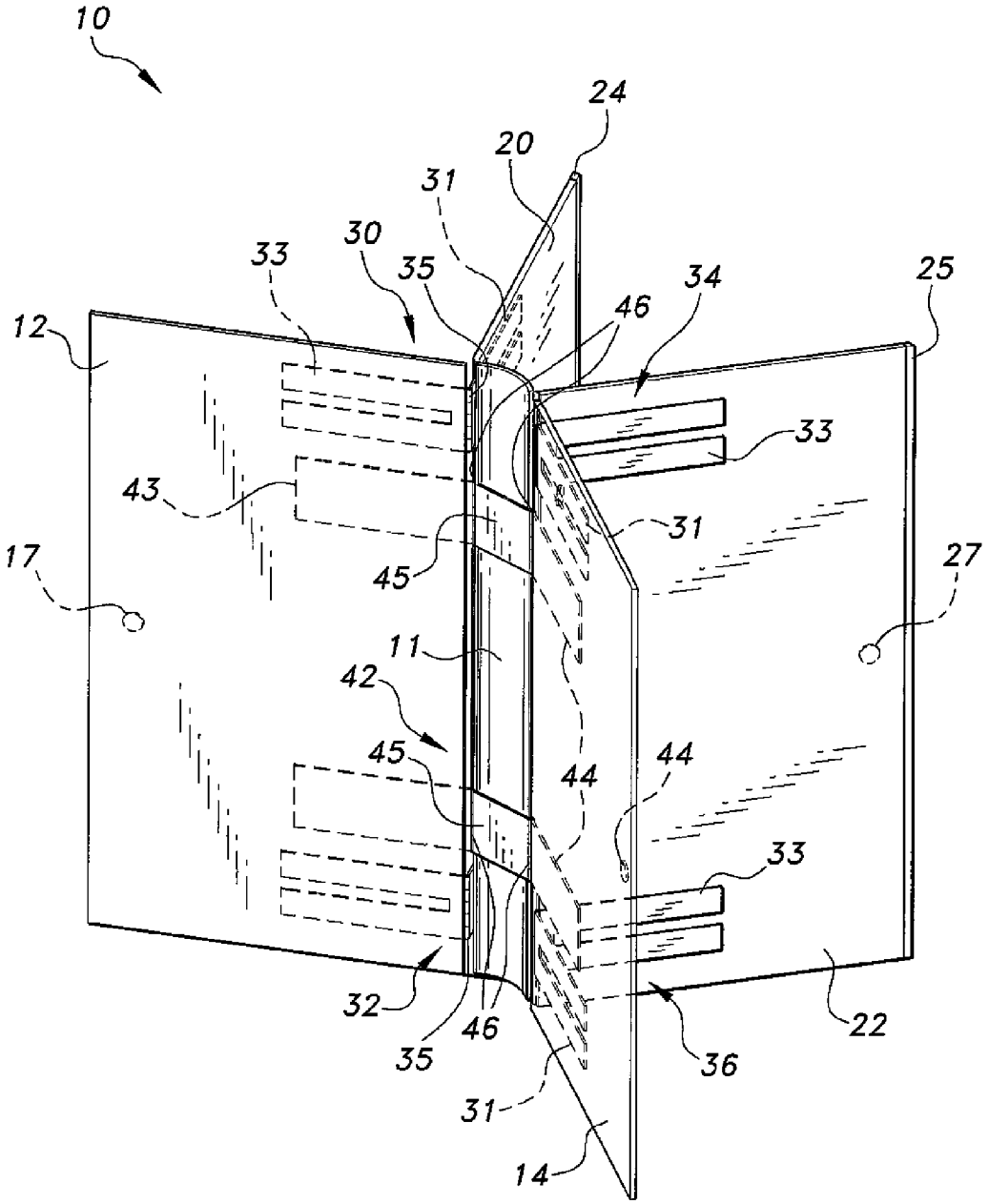
FIG. 2 is a perspective view of the convertible bookstand cover shown in FIG. 1 without the signatures of a book.
Figure 3:
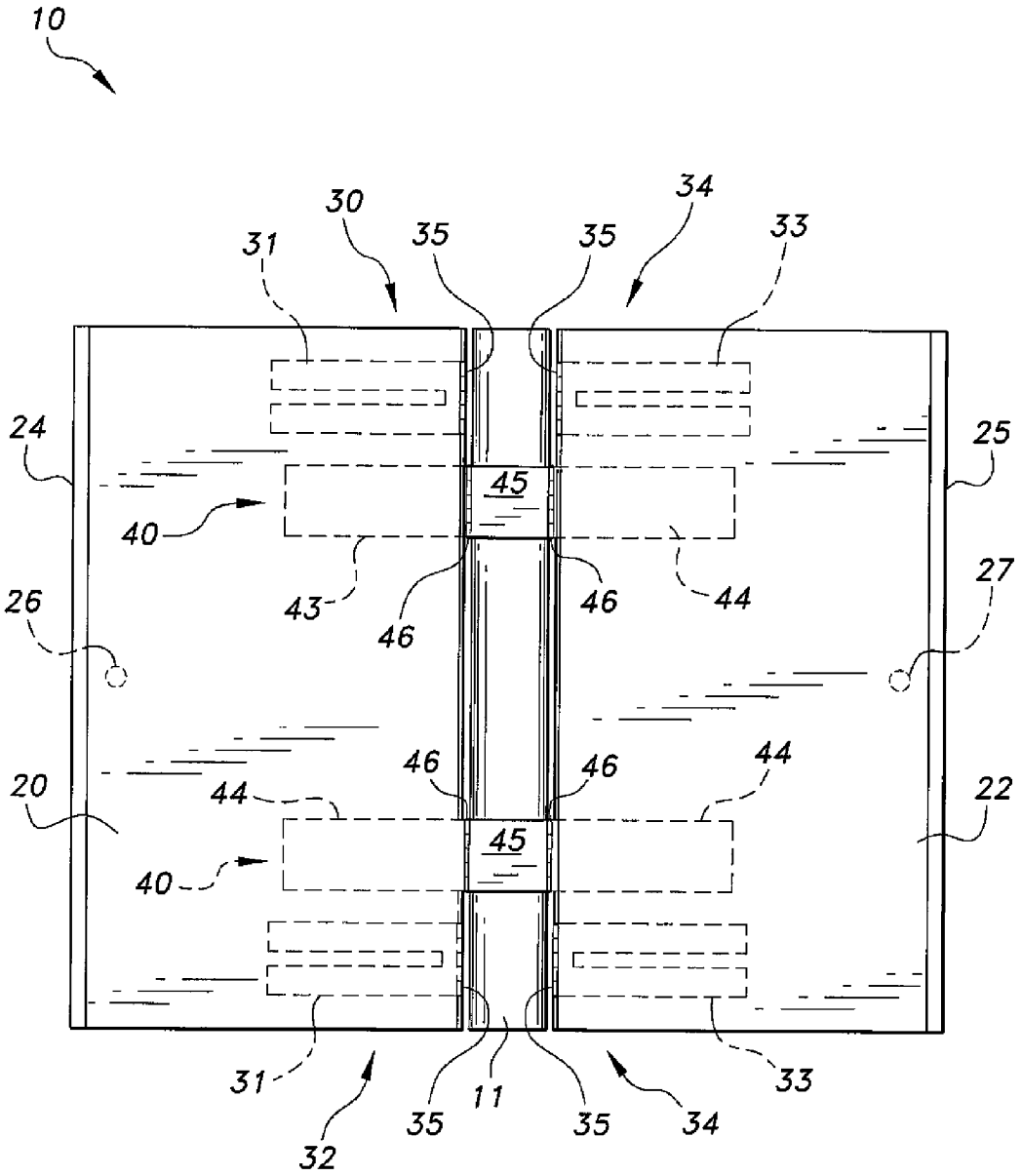
FIG. 3 is a plan view of the convertible bookstand cover shown in FIG. 1 without the inner covers.

The convertible bookstand cover, generally referred to by the reference number 10 in the drawings, provides integral bookstand features to a hardbound or hardcover book B for easy portability and use and eliminates the necessity of a separate bookstand. As shown in FIGS. 1-3, the convertible bookstand cover 10 includes a pair of elongate inner covers 12, 14 and a pair of elongate outer covers 20, 22, pivotally coupled to the inner covers 12, 14. The inner covers 12, 14 can also be referred to as a front inner cover 12 and a back inner cover 14. Similarly, the outer covers 20, 22 can also be referred to as a front outer cover 20 and a back outer cover 22 respectively. In the process of constructing the convertible bookstand cover 10, the inner covers 12, 14 can be provided in the form of an original or existing hardback covers of the book B or as separate covers replacing the original or existing hardback covers. Thus, the convertible bookstand cover 10 is a device that can be provided as an accessory mounted to hardbound books B or as a replacement for the typical covers of the hardbound book B protecting the contents or signatures contained therein.

Each inner cover 12, 14 is paired to a respective outer cover 20, 22 by at least one hinge 30, 32. As best seen in FIGS. 2, 3, 4A, and 4B, the front inner cover 12 is pivotally attached to the front outer cover 20 by a pair of spaced first hinges 30, 32. Each first hinge 30, 32 includes an elongate first wing, leaf or plate 31 and an elongate second wing, leaf or plate 33 pivotally connected to each other at a knuckle 35. The first wing 31 can be mounted substantially flush in the front inner cover 12, and the second wing 33 also can be mounted substantially flush in the front outer cover 20. The mounting of the wings 31, 33 to the corresponding front covers 12, 20 can be facilitated by adhesive bonding or by fasteners such as rivets, screws, and the like. The flushed disposition of the wings 31, 33 prevents formation of a gap between the front inner cover 12 and the front outer cover 20 when the front outer cover 20 is in a closed or folded position with respect to the front inner cover 12. This configuration is more aesthetically appealing and avoids potential deformation of the corresponding front covers 12, 20 from normal wear and tear.

The back inner cover 14 and the back outer cover 22 are similarly paired as above. A pair of spaced second hinges 34, 36 pivotally connects the back inner cover 14 to the back outer cover 22. Each second hinge 34, 36 has a similar construction as the first hinges 30, 32, and the same reference numbers have been used to designate the relevant parts thereof.

Figure 4A:
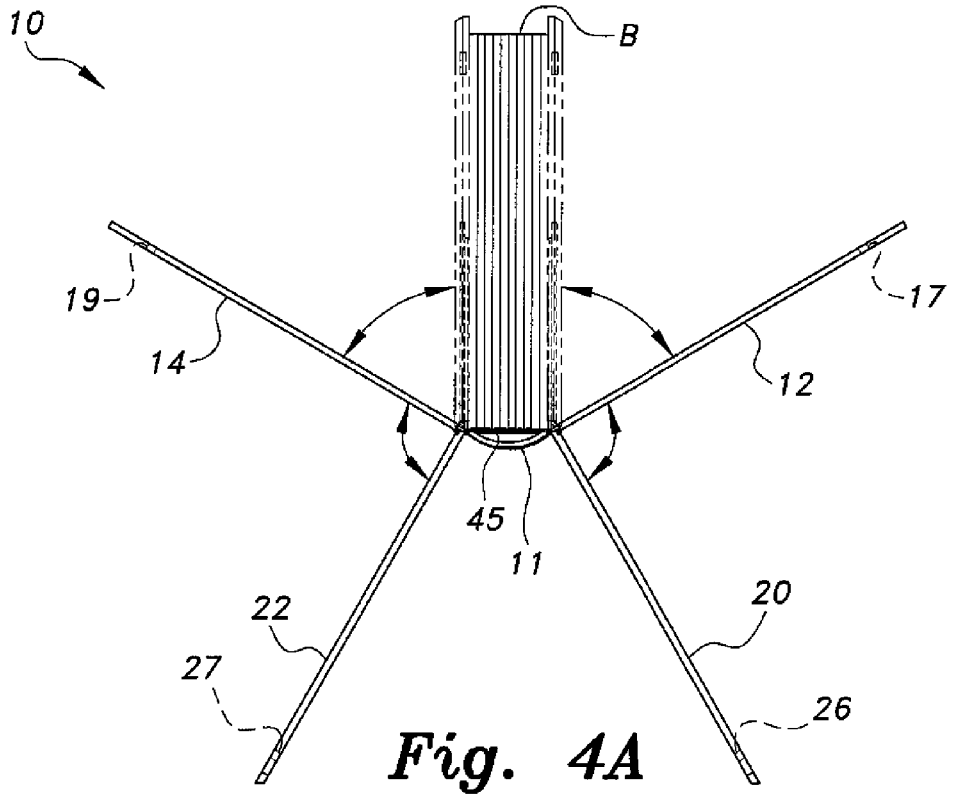
FIG. 4A is a top plan view of the convertible bookstand cover shown in FIG. 1 in one open position supporting the book.
Figure 4B:
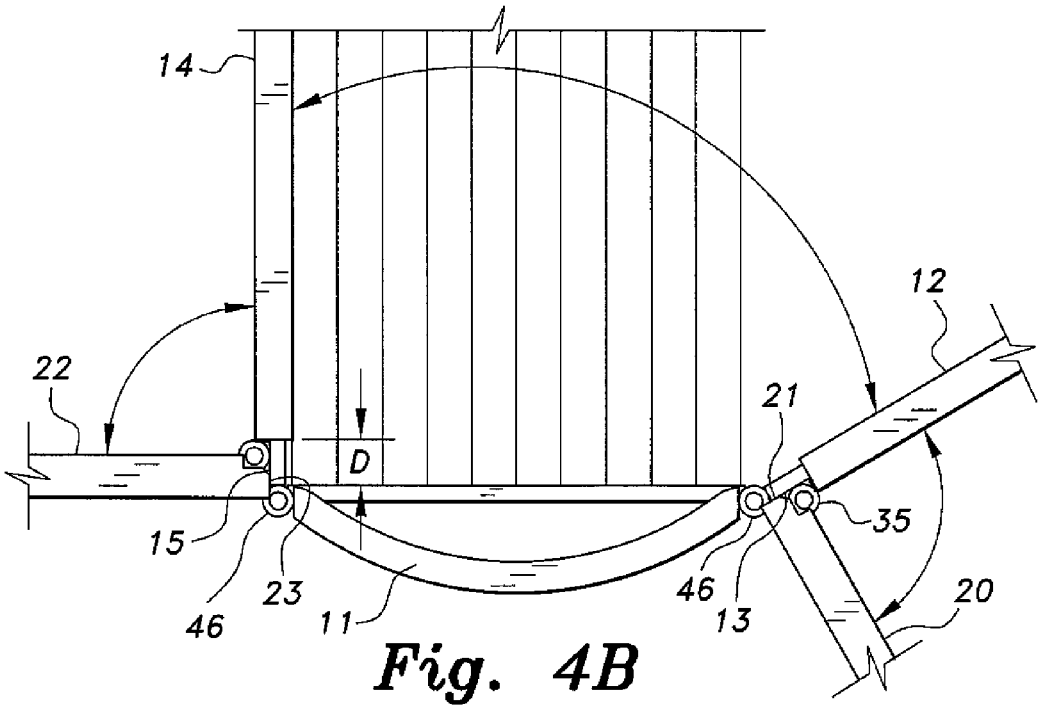
FIG. 4B is a detailed view of the hinge connection on the convertible bookstand cover shown in FIG. 4A.

In use, each outer cover 20, 22 unfolds from the corresponding inner covers 12, 14 to form a vertical support for the book B. To provide a stable configuration for supporting the book B, each outer cover 20, 22 is desirably pivoted to about 90 degrees or perpendicular with respect to the corresponding inner cover 12, 14. The pivoted positioning of the outer covers 20, 22 is facilitated by the disposition of the respective first hinges 30, 32 and the respective second hinges 34, 36. As best seen in FIG. 4B, each respective first hinge 30, 32 and second hinge 34, 36 is attached to the inner covers 12, 14 at a preselected distance D from the back edge of the inner covers 12, 14, thereby defining respective abutment surfaces 13, 15. The outer covers 20, 22 are connected to the corresponding first hinge 30, 32 and second hinge 34, 36 so that a back edge 21, 23 of the respective outer cover 20, 22 is substantially level with the knuckle 35 of the first hinge 30, 32 and second hinge 34, 36. When unfolded, the back edge 21, 23 of the outer covers 20, 22 forms an abutment resting against the abutment surfaces 13, 15. This maintains the outer covers 20, 22 at the desired 90 degree orientation with respect to the corresponding inner cover 12, 14.

The convertible bookstand cover 10 can be provided with alternative hinges that facilitate folding and unfolding of the outer covers 20, 22 to selected angles. For example, the first and second hinges 30, 32, 34, 36 can include incremental adjustable pivoting joints, a biased detent mechanism to lock the outer covers 20, 22 at the select angle, a sliding latch between the wings of each hinge that locks into place at predefined opened position of the outer covers 20, 22, and the like. Moreover, the first and second hinges 30, 32, 34, 36 can be configured to provide a wide range of angular orientations apart from the 90 degree orientation discussed above, suitable to form a vertical support. Furthermore, the first and second wings 31, 33 of the first and second hinges 30, 32, 34, 36, as shown in the drawing, can be substantially flat U-shaped plates, which minimize the material and weight thereof. However, these first and second wings 31, 33 can be provided in a variety of different shapes such as uniformly flat plates and other geometric shapes as desired or required by the user.

The outer covers 20, 22 also include features that increase comfort, enhance aesthetics, and secure attachment of the outer covers 20, 22 to the inner covers 12, 14 when folded. The width of the outer covers 20, 22 is slightly smaller than the width of the inner covers 12, 14. However, the width disparity creates a gap between the front edge of the outer cover 20, 22 and the corresponding front edge of the inner cover 12, 14. To compensate for the width disparity, each front edge of the respective outer cover 20, 22 is provided with a beveled strip 24, 25. The beveled strip 24, 25 provides a sloped front end rather than a sharp corner, which is more comfortable for handling by a user, aesthetically less aggressive and stark in comparison. Further, the beveled strip 24, 25 can be constructed from material different from the material of the cover, e.g., plastic, rubber, elastomers, leather, composites, and combinations thereof, to further enhance user handling and comfort. The resiliency and increased friction characteristics of some of these materials can also serve to help brace the outer covers 20, 22 on a surface when they are unfolded and converted to a bookstand.

In order to insure that the outer covers 20, 22 remain in place when folded, the convertible bookstand cover 10 includes a latching mechanism. The latching mechanism includes an outer cover magnet 26, 27 disposed at a select location inside each outer cover 20, 22. An inner cover magnet 17, 19 of opposite polarity is also mounted to respective inner covers 12, 14 in a position substantially opposite to the position of the outer cover magnets 26, 27 in the folded position. Thus, when folded or closed, the outer cover magnets 26, 27 in the outer covers 20, 22 interacting with the polar opposite inner cover magnets 17, 19 in the inner covers 12, 14 secures the attachment therebetween and substantially prevents undesirable or premature unfolding of the outer covers 20, 22. This also enhances portability by securely maintaining the folded position of the outer covers 20, 22 during transport.

The convertible bookstand cover 10 also includes a pair of third hinges 40, 42 that interconnect the inner covers 12, 14. The third hinges 40, 42 can be double-acting hinges each having an elongate first wing, leaf or plate 43 embedded into the front inner cover 12, an elongate second wing, leaf or plate 44 embedded into the back inner cover 14, and an intermediate wing, leaf or plate 45 connecting the first wing 43 to the second wing 44 at joints or knuckles 46. The intermediate wing 45 forms a portion of the spine 11 of the book B and reinforces the same. The joints 46 are configured to open the book B at about 120 degrees total. As such, the first wing 43 pivots outwardly about 60 degrees from the normal closed or folded position, and the second wing 44 also pivots outwardly about 60 degrees from the normal closed or folded position. The angular orientation of the first wing 43 and the second wing 44 can be maintained by protrusions or similar features on the knuckles 46, some examples of which has been described with respect to the first and second hinges 30, 32, 34, 36, that limit the range of pivotal movement of the first wing 43 and the second wing 44. The unfolded position of the inner covers 12, 14 also forms a bookstand support in concert with the outer covers 20, 22. Thus, when both the inner covers 12, 14 and the outer covers 20, 22 are unfolded, they form a substantially X-patterned support for the book B when seen from the top as best shown in FIG. 4A, such a pattern being a very stable configuration for books any size.

It is to be understood that the convertible bookstand cover 10 encompasses a variety of alternatives. For example, each cover can be constructed from various conventional and non-conventional book cover materials such as cardboard, paper, leather, wood, plastic, steel, composites, combinations thereof, and the like. Moreover, each cover can be provided in various colors and/or with various indicia, for example, as replacements for the typical titles and/or images on the covers of conventional books or as identification of authors and/or business. Furthermore, at least with respect to the outer covers, the indicia can be provided in the form of embossing or bas relief.

It is to be understood that the present invention is not limited to the embodiments described above, but encompasses any and all embodiments within the scope of the following claims.

I claim:

1. A convertible bookstand cover, comprising:

at least one pair of inner covers forming covers for a book;

at least one pair of outer covers each selectively covering a corresponding inner cover;

wherein the at least one pair of outer covers comprises a front outer cover and a back outer cover; and a plurality of hinges pivotally connecting the at least one pair of outer covers to the at least one pair of inner covers and the at least one pair of inner covers to each other;

wherein the plurality of hinges comprises at least one pair of spaced first hinges, the at least one pair of first hinges pivotally connecting the front outer cover to one of the at least one pair of inner covers, and the outer covers are pivotable to a predefined angle forming a bookstand support.

2. The convertible bookstand cover according to claim 1, wherein the plurality of hinges comprises at least one pair of spaced second hinges, the at least one pair of second hinges pivotally connecting the back outer cover to the other of the at least one pair of inner covers.

3. The convertible bookstand cover according to claim 2, wherein each the inner cover comprises a back edge, the at least one pair of first hinges and the at least one pair of second hinges being disposed a predefined distance from the back edge of a respective inner cover, the predefined distance defining an abutment surface.

4. The convertible bookstand cover according to claim 3, wherein each the outer cover comprises a back edge, the back edge of each the outer cover adapted for selective abutment with the abutment surface on each corresponding the inner cover when the outer cover selectively unfolds to the predefined angle.

5. The convertible bookstand cover according to claim 4, wherein the predefined angle comprises about 90 degrees.

6. The convertible bookstand cover according to claim 2, wherein each the first hinges and the second hinges comprises: a first wing, a second wing, and a knuckle pivotally connecting the first wing to the second wing.

7. The convertible bookstand cover according to claim 1, wherein each the first wing and the second wing is pivotable from a closed position to an open position of about 60 degrees from the closed position.

8. The convertible bookstand cover according to claim 1, further comprising a beveled strip on at least one edge of each the outer cover.

9. The convertible bookstand cover according to claim 8, wherein the beveled strip is constructed from a material different from material of the outer cover.

10. The convertible bookstand cover according to claim 1, further comprises a latching mechanism for preventing at least the outer covers from unfolding inadvertently.

11. The convertible bookstand cover according to claim 10, wherein the latching mechanism comprises at least one magnet disposed in each inner cover and each outer cover, the at least one magnet in each outer cover having a magnetic charge opposite from the at least one magnet in each inner cover.

12. A convertible bookstand cover, comprising:

at least two pairs of covers forming a cover for a book, at least one pair of the at least two pairs of covers pivotable between a folded position to an unfolded position at a predefined angle forming a vertical bookstand support;

wherein the at least two pairs of covers comprises at least one pair of inner covers and at least one pair of outer covers, the at least one pair of outer covers pivotable to the predefined angle to form the vertical bookstand support; and a plurality of hinges pivotally connecting the at least two pairs of covers to each other;

wherein the plurality of hinges comprises at least one pair of first hinges and at least one pair of second hinges, each pair of first hinges and pair of second hinges pivotally connecting a corresponding outer cover to a respective inner cover, and at least one third hinge pivotally connecting each pair of inner covers to each other.

13. The convertible bookstand cover according to claim 12, further comprising at least one magnet embedded in each cover, the at least one magnet preventing undesirable unfolding of one cover with respect to the other.

14. A convertible bookstand cover, comprising:

at least one pair of inner covers forming covers for a book;

at least one pair of outer covers each selectively covering a corresponding inner cover; wherein the at least one pair of inner covers comprises a front inner cover and a back inner cover, the front inner cover and the back inner cover each being pivotable between a closed position and an unfolded position, the unfolded position forming an additional bookstand support working in concert with the outer covers; and a plurality of hinges pivotally connecting the at least one pair of outer covers to the at least one pair of inner covers and the at least one pair of inner covers to each other;

wherein the plurality of hinges includes at least one pair of spaced hinges, the at least one pair of hinges pivotally connecting the front inner cover to the back inner cover;

wherein each hinge of the at least one pair of hinges includes a double-acting hinge having an elongate first wing embedded in the front inner cover, an elongate second wing embedded in the back inner cover, an intermediate wing coupled to the first wing and the second wing; and at least one pair of knuckles disposed at opposite ends of the intermediate wing;

wherein the knuckles are pivotally coupling the corresponding first wing and the corresponding second wing to the intermediate wing;

wherein the outer covers are pivotable to a predefined angle forming a bookstand support.

15. The convertible bookstand cover according to claim 14, further comprising a beveled strip on at least one edge of each the outer cover.

16. The convertible bookstand cover according to claim 15, wherein the beveled strip is constructed from a material different from material of the outer cover.

17. The convertible bookstand cover according to claim 14, further comprises a latching mechanism for preventing at least the outer covers from unfolding inadvertently.

18. The convertible bookstand cover according to claim 17, wherein the latching mechanism comprises at least one magnet disposed in each inner cover and each outer cover, the at least one magnet in each outer cover having a magnetic charge opposite from the at least one magnet in each inner cover.

19. The convertible bookstand cover according to claim 14, further comprising at least one magnet embedded in each cover, the at least one magnet preventing undesirable unfolding of one cover with respect to the other.

20. The convertible bookstand cover according to claim 14, wherein each first wing and each second wing are pivotable from a closed position to an open position in an angular range between 60 degrees and 90 degrees from the closed position.

* * * * *